US005907879A

United States Patent [19]

Downey

[11] Patent Number: 5,907,879

[45] Date of Patent: Jun. 1, 1999

[54] HIGH FLOW STEAM CARPET CLEANER

[76] Inventor: Mike Downey, 1041 S. Clark Blvd., Clarksville, Ind. 47129

[21] Appl. No.: 08/761,745

[22] Filed: Dec. 5, 1996

[51] Int. Cl.[6] ..... B08B 5/04; A47L 7/00

[52] U.S. Cl. ..... 8/158; 15/320; 15/321; 15/353; 15/339

[58] Field of Search ..... 15/320, 321, 353; 134/21; 8/158

[56] References Cited

U.S. PATENT DOCUMENTS

| | | | |
|---|---|---|---|
| 3,883,301 | 5/1975 | Emrick et al. | 8/158 |
| 3,909,197 | 9/1975 | Cremers | 8/158 |
| 3,939,527 | 2/1976 | Jones | 15/320 X |
| 3,940,826 | 3/1976 | Phillips et al. | 15/320 |
| 3,974,541 | 8/1976 | Slivis et al. | 15/320 |
| 4,080,104 | 3/1978 | Brown . | |
| 4,114,229 | 9/1978 | Jones et al. | 15/320 |
| 4,307,484 | 12/1981 | Williams | 15/321 |
| 4,378,611 | 4/1983 | Ninehouser . | |
| 4,458,377 | 7/1984 | Frohbieter | 15/321 X |
| 4,723,337 | 2/1988 | Ellison et al. . | |

*Primary Examiner*—Chris K. Moore
*Attorney, Agent, or Firm*—Middleton & Reutlinger; John F. Salazar, Esq.

[57] ABSTRACT

A lightweight portable steam carpet cleaning machine 10 comprised of two main structures, a handle assembly 45 and the recovery tank 12. Connected to the machine are two hoses, the supply hose 58 which supplies clear water to the machine and the discharge hose 60 which takes dirty water away depositing it in a sanitary disposal. A 27 capacity spray jet 44 is used to apply a high volume of clear water to the carpet. A recovery tank 12 which is less than a cubic foot in volume is used to transport the vacuum from the vacuum motor 24 to the water pick-up 56. During the cleaning process, a channel 84 is used to direct extracted water to the bottom of the recovery tank 12. A float switch 36 is used to automatically activate or deactivate the discharge pump 26 during the cleaning process.

3 Claims, 4 Drawing Sheets

HIGH FLOW STEAM CARPET CLEANER

BACKGROUND OF THE INVENTION

1. Field of the Invention

The present invention relates to steam carpet cleaning machines.

2. Discussion of the Prior Art

The machine of the present invention relates to portable hot water extractors, also called portable steam carpet cleaners. These machines have almost always been self-contained. By self-contained it is meant it has a holding tank for its cleaning water and a large recovery tank 12 for the dirty water. These machines work by pulling water from the holding tank with a high pressure pump, spraying it on the carpet and recovering it with a vacuum source forming a water pick-up area.

Traditionally, the main problem with steam carpet cleaning machines has been their over wetting of carpets. This over wetting is due to the inability of these machines to generate enough vacuum or suction at the carpet. This inability has led to restricting the amount of water used in the cleaning process. This restriction in water flow has limited the cleaning ability of these machines.

The water recovery systems within these machines produces much less vacuum or suction at the carpet than the machine described herein, even though they often use the same type of vacuum motor. This is caused by three reasons:

1) The much longer distance between their vacuum motor and water pick-up;

2) The comparatively large volume of air contained in their recovery tanks;

3) The comparatively large area the vacuum acts upon on the inside of their recovery tanks.

All steam carpet cleaning machines have recovery tanks. These are the tanks which hold the recovered water sprayed onto the carpet. Other than the machine of the present application, there are only two other known types of portable steam carpet cleaning machines. Both of these types have similar recovery tanks:

1) Self-Contained Pull Behind Machines which have recovery tanks in the 7 to 10 gallon range;

2) Box and Wand Machines which have recovery tanks in the 10 to 18 gallon range.

The main difference with these two types of machines is that the box and wand has a vacuum hose running from the recovery tank 12 to the cleaning wand. The self-contained pull behind has the cleaning wand connected directly to the recovery tank 12.

How these recovery tanks work is as follows. A vacuum motor capable of generating anywhere from 2 to 4 HP is mounted on the outside of the recovery tank 12. A vacuum hole in the recovery tank 12 allows the vacuum generated by the vacuum motor to enter the tank. When the wand or water pick-up part of the machine makes contact with the carpet, it partially closes the system. The vacuum motor immediately starts removing air from the recovery tank 12. As air is removed from the recovery tank 12 a vacuum or suction is exerted on both the inside area of the vacuum tank and the carpet that is under the water pick-up. This vacuum increases as more and more is removed from the recovery tank 12.

Since all vacuum motors are limited in the amount of air they can remove per minute, it stands to reason that the smaller the volume of air in the recovery tank 12 the faster the vacuum will act at the carpet under the water pick-up. Also since all vacuum motors are limited in the power they can generate, it stands to reason that the fewer square inches this power has to act upon the more vacuum response it will be to the areas that it does act on.

In a large recovery tank 12 much of the power generated by the vacuum motor is wasted by acting on the large inside volume of the recovery tank 12. To get as much vacuum to the carpet as possible, it is vitally important to reduce both the volume and the inside area of the recovery tank 12. By doing this you usually reduce the distance between the vacuum motor and the water pick-up.

SUMMARY OF THE INVENTION

The recovery tank 12 on the present has 3 to 7 times less volume than any other machine. The inside area of the recovery tank 12 is anywhere from 2.5 to 5 times smaller than any other machines. The recovery tank 12 is less than one cubic foot in volume. It mounts less than 14 inches from the water pick-up. In operation, it provides more powerful vacuum much quicker at the carpet than other machines. This is true even when using identical vacuum motors. What this means for the machine described herein is that it has a much higher percentage of water recovery. Percentage of water recovery equals the total water recovered divided by the total water used.

Percentage of water recovery=total water recovered/total water used

The importance of reducing both the volume and the inside surface area of the recovery tank 12 has been previously mentioned. One dimension, that is difficult to reduce, is the height of the recovery tank 12. The reason for this is there has to be sufficient distance between the highest recovered water level on the inside of the recovery tank 12 and the place where the vacuum enters the recovery tank 12. If the vacuum enters the recovery tank 12 too close to the highest recovered water level, it will draw the recovered water into the vacuum motor. The vacuum generated by the vacuum motor enters the recovery tank 12 about 9.5 inches from the bottom of the recovery tank 12. The highest recovered water level on the bottom of the tank is about 3 inches. This gives the machine a height differential of about 6.5 inches. This height differential is vitally important in protecting the vacuum motor and is an extremely important concept concerning the functionality of the machine.

Because of the extremely high percentage of water recovery the machine generates, it is able to increase the amount of water used in the cleaning process. A water flow rate of one gallon per minute is high for most portable steam cleaning machines. The present machine has a flow rate of 3 to 4 gallons of water per minute. This high flow rate is 3 to 4 times greater than other machines. Even with this increased water flow, the machine has consistently had much better drying times than other machines using less than one-third the water flow.

What allows this high flow in this machine is the size of the spray jet. It uses a 27 capacity (0.173 orifice diameter) spray jet. Most machines use 6 capacity (0.062" orifice diameter) or less.

The increase in water flow allows the machine described herein to flush more foreign matter (dirt, soil, bacteria, etc.) from carpets much faster than other machines. The cleaning ability of this machine so far surpasses other machines that it is considered by some as a new concept in carpet cleaning. What this machine does that has never been done before is to provide a controlled flood style of cleaning carpet. It generates a flushing effect in carpets, using its powerful vacuum system to dislodge more foreign matter from carpets, much faster than previously possible.

The machine of the present application has improved many aspects of the portable steam carpet cleaning process including:

1) It uses a much higher clear water flow (3 to 4 times higher than other machines) which rinses fibers more thoroughly than previously possible;
2) Using the same or similar vacuum motor it generates such a high vacuum at the carpet that even with more than 3 times the water flow, it leaves carpets much dryer than other machines. It solves the "over wetting" problem associated with portable steam carpet cleaning machines;
3) Operators can clean faster and more throughly than previously possible. This reduces labor cost and increases quality;
4) The operating weight is less than half of most other machines. It's so small it can fit into the trunk of most cars. Most other machines need a truck for transportation;
5) Because it is lightweight and of the straight upright position of the operators back when cleaning with the present machine, the chronic back problems commonly associated with carpet cleaners is greatly reduced; and
6) It will increase in indoor air quality in carpet environment, after use.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
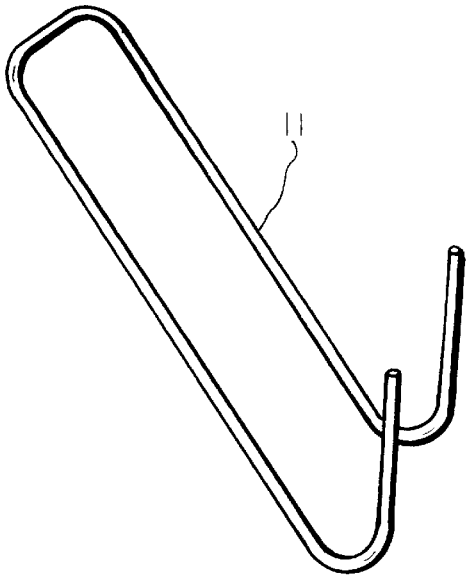
FIG. 1 is a perspective view of the handle for the carpet steam cleaner of the present invention.
Figure 2:
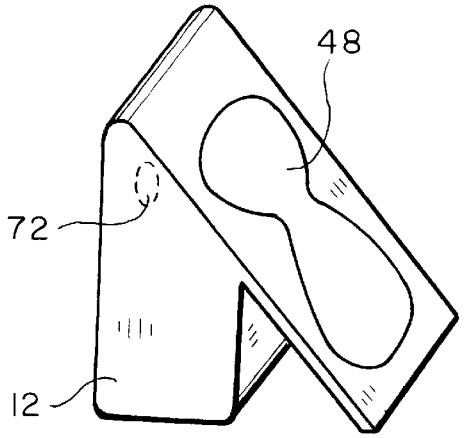
FIG. 2 is a perspective view of the recovery tank with vacuum hole and window channel opening for the steam cleaner of the present invention.

The high flow steam carpet handle has two main structures, the handle 11 and recovery tank 12, shown in FIGS. 1 and 2.

Figure 3:
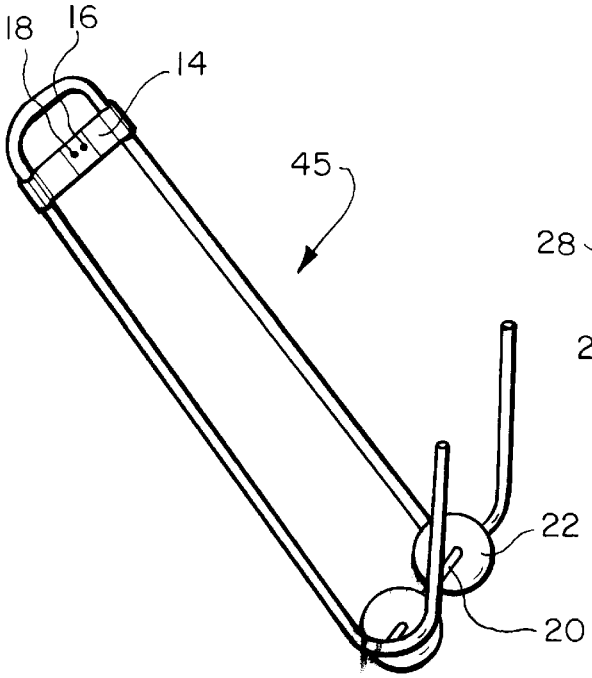
FIG. 3 is a perspective view of the handle assembly of the carpet steam cleaner of the present invention.
Figure 4:
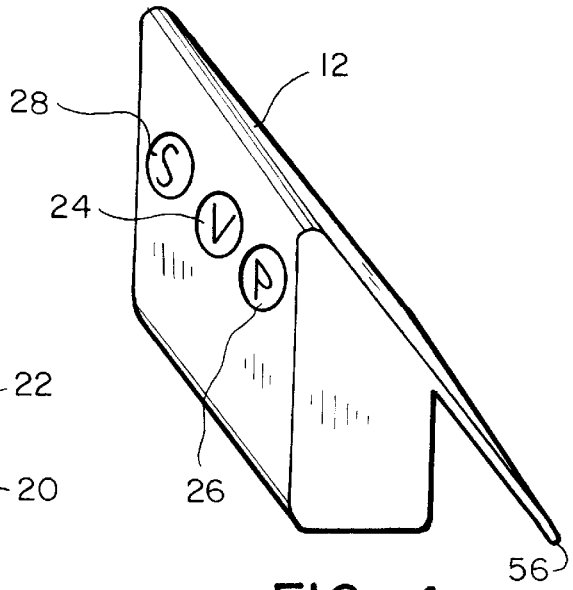
FIG. 4 shows a perspective view of the back of the recovery tank of the present invention.

The handle 11 is made of 1 inch O.D. 18 gauge steel. Attached to the handle are two essential assemblies. The control panel assembly 14 (FIG. 3) is made of ⅛" vacuum formed plastic. This control panel assembly 14 contains two switches 16 and 18. The vacuum switch 16 (FIG. 3) is used to turn the vacuum motor 24 (FIG. 4) on and off. The other switch on the control panel assembly 14 (FIG. 3) is the spray jet switch 18 (FIG. 3). This switch is used to either open or close the solenoid valve 28 (FIG. 4). The other essential assembly connected to the handle is the axle assembly 20 (FIG. 3). This assembly 20 attaches to the bottom of the handle as shown in FIG. 3. The wheels 22 (FIG. 3) go on the axle assembly 20 (FIG. 3) at opposite distal ends of the axle 20. When both the control panel assembly 20 and the axle assembly are attached to the handle, it is called the handle assembly 45 (FIG. 3).

Figure 9:
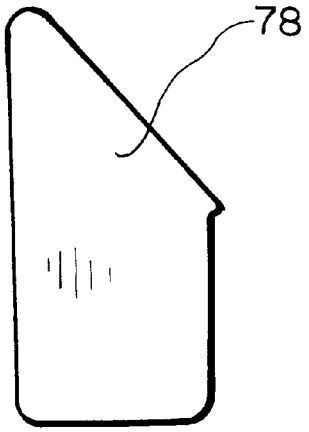
FIG. 9 shows side view of one end cap for the recovery tank of the present invention.
Figure 11:
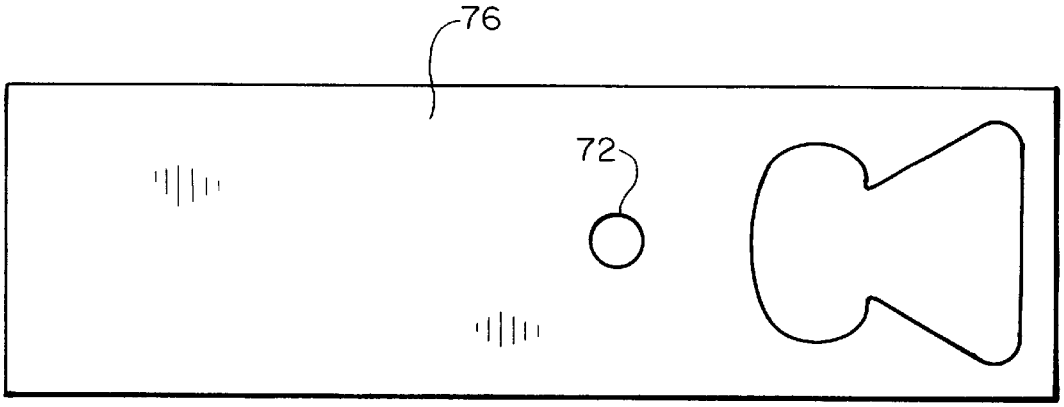
FIG. 11 shows a top view of the main body of the recovery tank on the flat before formation.
Figure 12:
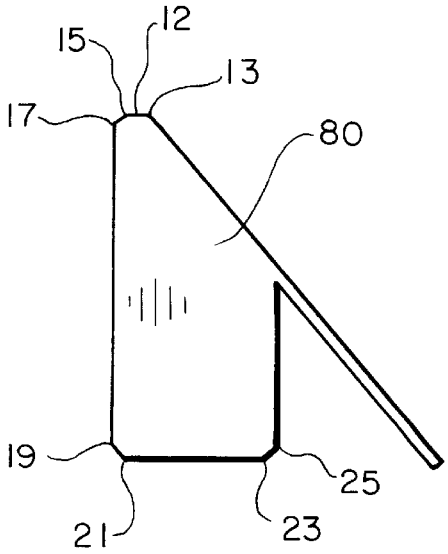
FIG. 12 shows side view of the main body of the recovery tank of the present invention after bending; and, FIG. 13 shows the window channel assembly of the present invention.

The second main structure on the machine 10 is the recovery tank 12. (FIG. 2). This recovery tank 12 is made of 3 pieces of 0.063 thickness 5052 H-32 aluminum. The main body of the recovery tank 12 is formed out of the flat 76 (FIG. 11). The flat 76 is then molded to form the main body of the recovery tank 80 as is shown in FIG. 12. The remaining two pieces of the recovery tank 12 are the end caps 78 shown in FIG. 9. These two pieces are identical and are welded to either side of the main body of the recovery tank 12. As can be seen in FIG. 12, seven of the eight bends, 13, 15, 17, 19, 23 and 25, in the main body of the recovery tank 12 are 45 degrees bends. This is done to strengthen the inside of the recovery tank 12. This construction reduces the flexing of the tank when subjected to strong vacuum, maintaining its yield strength.

Once the recovery tank 12 is formed and welded, five structures are mounted together to form the machine 10. The recovery tank 12 contains the vacuum motor 24 (FIG. 4) designated with a circled V, the discharge pump 26 (FIG. 4) designated with a circled P, and the solenoid valve 28 (FIG. 4) designated with a circled S. Connected therewith are the engine compartment housing 30 (FIG. 5), and the handle assembly 45 (FIG. 3) which is shown connected to the recovery tank in FIG. 5.

Figure 6:
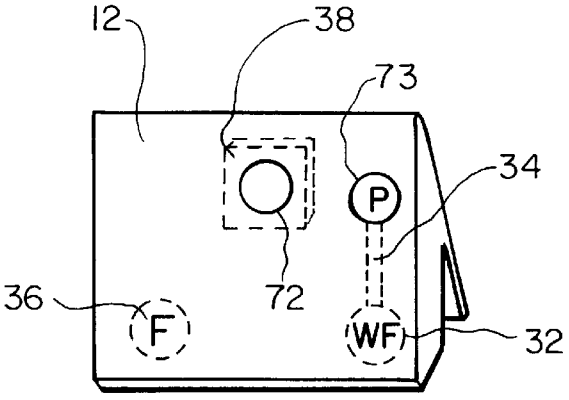
FIG. 6 shows a perspective view of the back of the recovery tank showing the parts contained within the recovery tank of FIG. 5.

The vacuum motor 24 (FIG. 4) mounts over a hole in the back and in FIG. 6 of the recovery tank 12. This hole is called the vacuum hole 72 and is shown in phantom in FIG. 2. This hole, as indicated, is on the back wall of the recovery tank 12. This allows vacuum to enter the recovery tank 12.

The discharge pump 26 (FIG. 4) mounts over a hole 73 in the back of the recovery tank 12. The discharge pump 26 is attached to the recovery tank 12 discharge hose 34 (FIG. 6) which connects the pump 26 to the water filter 32 (FIG. 6) which is also located in the recovery tank 12.

The solenoid valve 28 (FIG. 4) also mounts to the back of the recovery tank 12. This valve controls water flow to the spray jet 44 shown in FIGS. 7 and 8.

The engine compartment housing 30 (FIG. 5) also mounts on the back of the recovery tank 12. This housing 20 is made out of ⅛ inch thick vacuum formed plastic. Its main function is to cover and protect the vacuum 24, pump 26 and valve 28, and such from dust, lint, water, etc.

Figure 5:
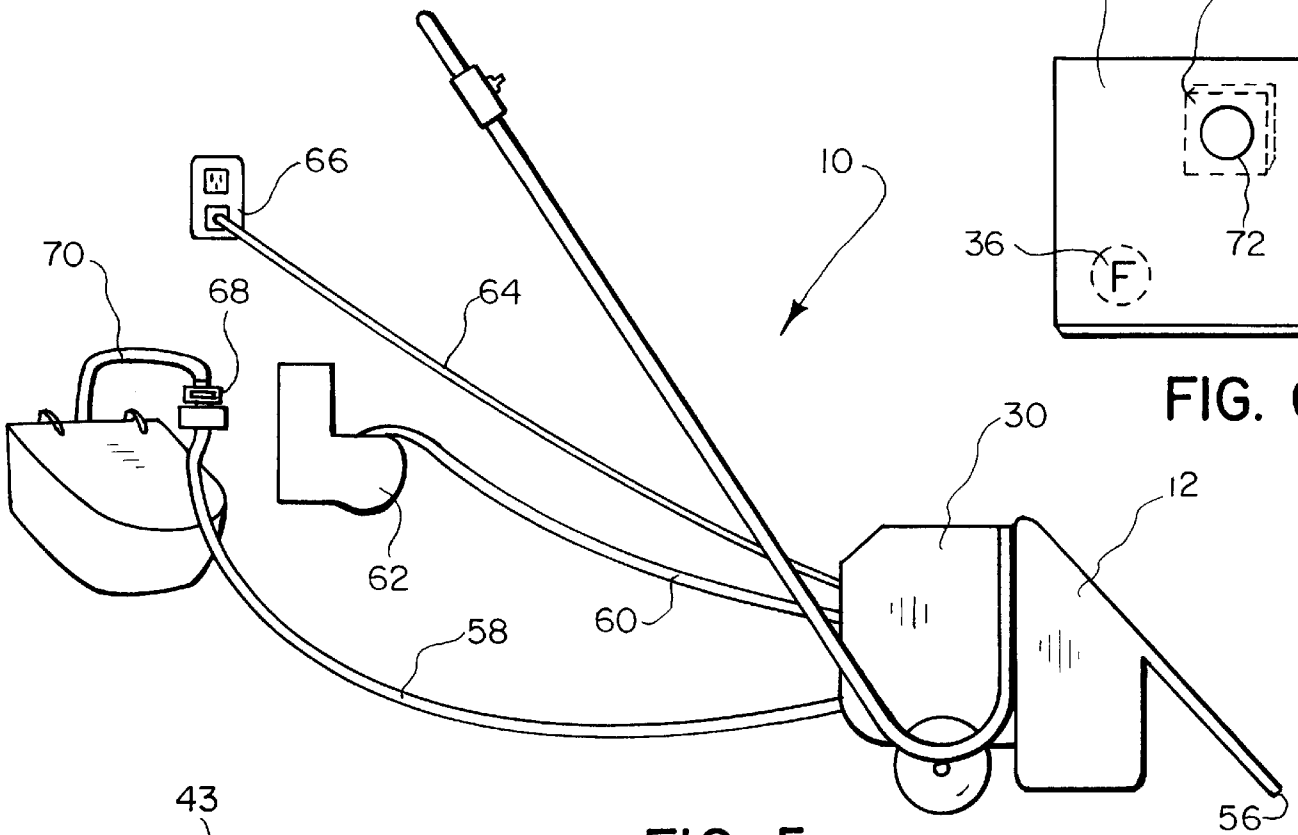
FIG. 5 shows a side view of carpet cleaning machine of the present invention with hoses attached.

The handle assembly 45 (FIG. 3) also attaches on the back of the recovery tank 12 as shown in FIG. 5. On the inside of the recovery tank 12 are three essential parts. The float switch 36 (FIG. 6) designated with a circled F. The water filter 32 (FIG. 6) designated with a circled WF, and the baffle 38 (FIG. 6). The float switch 36 (FIG. 6) regulates the amount of extracted water contained in the recovery tank 12. When the water level reaches three inches on the inside of the recovery tank 12, the float switch activates the discharge pump 26 (FIG. 4). The discharge pump starts pumping the water out of the recovery tank 12 until the water level, on the inside of the recovery tank 12, goes down to ½ inch. When the water level is ½ inch on tank 12, the float switch 36 (FIG. 6) deactivates the discharge pump.

The water filter 32 (FIG. 6) filters the extracted water, in the recovery tank 12, from hair, lint, sand, etc. This is used to protect the discharge pump 26 (FIG. 4). It is made from 26 gauge perforated stainless steel, with 0.032 diameter holes.

The baffle 38 (FIG. 6) mounts over the vacuum hole 72 (FIG. 2) on the inside of the recovery tank 12. It is made from ⅛ inch thick vacuum formed plastic. The opening on the baffle 38 that allows vacuum to enter the recovery tank 12 is located as high up on the baffle as possible. This opening is used to channel the vacuum generated by the vacuum motor 24 (FIG. 4) to the top of the recovery tank 12. This creates the height differential between the vacuums entrance point and the highest extracted water level. This prevents the vacuum motor from drawing in the extracted water on the bottom of the recovery tank 12.

An optional air filter (not shown) goes over the opening on the top of the baffle. This filter can be made out of foam, perforated metal, etc. It is mainly used when the machine is being used for dry vacuuming. In dry vacuuming, the hair and lint being drawn into the recovery tank 12 can damage the motors. This air filter prevents it from being drawn into the vacuum motor.

Figure 7:
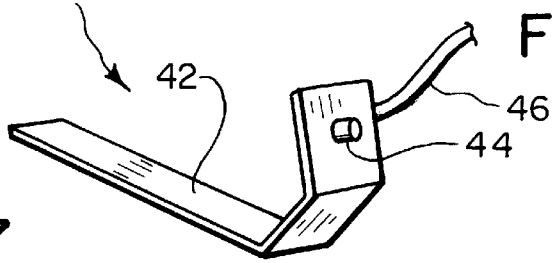
FIG. 7 shows the spray jet assembly attached to the machine of FIG. 5.
Figure 8:
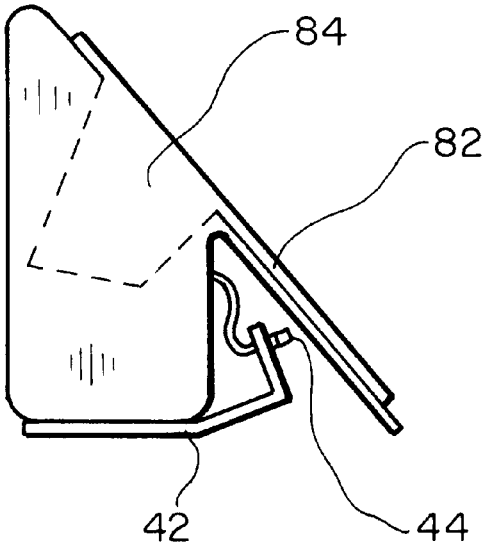
FIG. 8 shows a side view of recovery tank of FIG. 6 with a window channel assembly and spray jet assembly attached.

The spray jet assembly 43 (FIG. 7) contains the spray jet support 42 (FIG. 7), the spray jet 44 (FIG. 7), and the spray jet supply hose 46 (FIG. 7). This assembly mounts 43 on the bottom of the recovery tank 12 as shown in FIG. 8. The spray jet support 42 (FIG. 8) is used to secure the spray jet 44 (FIG. 7) in a fixed position. The spray jet supply hose 46 (FIG. 7) attaches to the front of the solenoid valve 28 (FIG. 4) and provides water flow, when the solenoid valve 28 (FIG. 4) is open.

On the front face of the recovery tank 12 is a large opening 48. This opening is called the window channel opening 48 (FIG. 2). This window channel opening 48 (FIG. 2) is where the window channel assembly 50 (FIG. 13) fits. The window channel assembly is made of three main parts. The window 82, the channel 84, and the window gasket 86. The window 82 is made out of clear plastic and provides a visual effect when extracting. The operator is able to see what is being removed out of the carpet.

Figure 13:
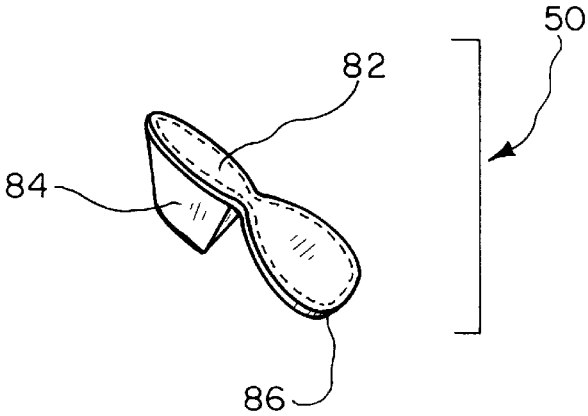

The channel 84 is made out of vacuum formed plastic and attaches to the window 82 (FIG. 13). The channel 84 directs the extracted water entering the recovery tank 12 towards the bottom of the recovery tank 12. Without this channel the extracted water would easily be drawn through the baffle 38 (FIG. 6) and into the vacuum motor 24 (FIG. 4).

The window gasket 86 goes around the outside of the window 82. When the vacuum motor 24 (FIG. 4) is turned on, the vacuum generated by it pulls the window channel assembly 50 ( FIG. 13) against the front face of the recovery tank 12. This window gasket 86 (FIG. 13) seals the window channel assembly 50 (FIG. 13) against the front face of the recovery tank 12 during operation.

Figure 10:
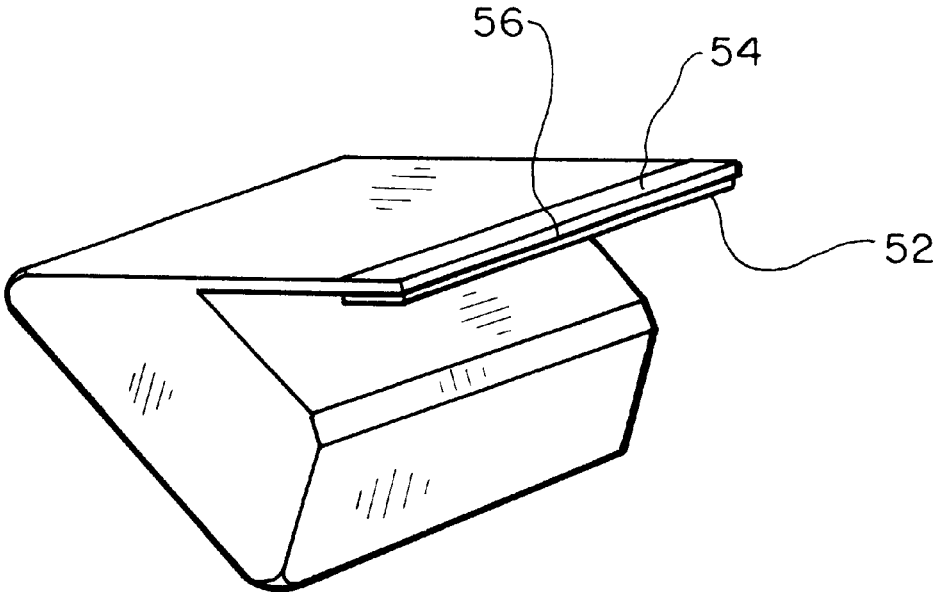
FIG. 10 shows perspective view of recovery tank of the present invention showing the water pick-up between the inner and outer lips.

Attached to the very front of the recovery tank 12 are an inner lip 52 and an outer lip 54 shown in FIG. 1. Both the inner and outer lips are made of 18 gauge stainless steel and provide a tough long lasting surface for the water pick-up portion 56 of the machine. The inner lip 52 and outer lip 54 are attached with about an ⅛ inch gap between them. The ⅛ inch gap forms a channel to the inside of the recovery tank 12. This ⅛ inch gap and the channel are called the water pick-up 56 (FIG. 10). This water pick-up allows vacuum generated by the vacuum motor 24 to contact the carpet. The vacuum draws water out of the carpet, between the lips 52 and 54, up the channel 56 and into the recovery tank 12.

Two things are required to allow the machine 10 to perform at high efficiency. A constant high volume clear water source and the ability to discharge a high volume of extracted water. These two things are achieved with two hoses. The supply hose 58 (FIG. 5) and the discharge hose 60 (FIG. 5). The supply hose 58 (FIG. 5) provides a source of clear water to the machine. On one end it connects to a clean water source from a sink or faucet 70 (FIG. 5) and on the other end connects behind the solenoid valve 28 (FIG. 4).

The discharge hose 60 (FIG. 5) provides a way for the machine 10 to get rid of extracted water. It connects on one end to the back of the discharge pump and on the other end into a toilet 62 or other drain (FIG. 5).

Another item the machine 10 needs to operate is an electric source. Since the machine 10 runs on a regular AC current, this is easily achieved with a power cord 64 (FIG. 5). The power cord on one end runs to the electrical parts (motors, etc.), and on the other end to a wall socket 66 (FIG. 5).

To make the machine practical it needs both a constant high volume water source, and the ability to discharge the dirty extracted water. This is achieved as follows. By using a faucet adapter 68 (FIG. 5), the machine 10 supply hose 58 (FIG. 5) is connected directly to the faucet 70 (FIG. 5). This gives the machine 10 access to a high flow pressurized water system. Once connected to the water system the hot water is turned on. The normally closed solenoid valve 28 (FIG. 4) blocks any water flow until you are ready to clean. Next, insert the end of the discharge hose 60 (FIG. 5) into the toilet 62 (FIG. 5) or other sanitary disposal. Next, plug the power cord 64 (FIG. 5) into a wall socket 66 (FIG. 5).

With the operator's hands on the top of the handle, the operator's fingers have easy access to the vacuum switch 16 (FIG. 3) and the spray jet switch 18 (FIG. 3) located on the control panel assembly 14 (FIG. 3) turn the vacuum switch 16 (FIG. 3) on which turns the vacuum motor 24 (FIG. 4) on and which supplies immediate vacuum or suction to the water pick-up 56 (FIG. 10).

To clean, turn the spray jet switch 18 (FIG. 3) on. This opens the solenoid valve 28 allowing water from the faucet to pass through it to the spray jet 44 which sprays the water on the carpet. Pull the machine backwards to extract the water. As the machine is pulled backwards, the water pick-up 56 (FIG. 10) vacuums the water back out of the carpet. To stop this cleaning process, turn the spray jet switch off. This closes the solenoid valve and water flow to the spray jet 44 stops.

As the machine 10 is operated, pulling the machine backwards with spray jet switch on, the water pick-up 56 (FIG. 10) draws the dirty extracted water into the recovery tank 12. Once inside the recovery tank 12 the dirty water is directed by the channel 84 (FIG. 13) to the bottom of the recovery tank 12. When the level of dirty water on the bottom of the recovery tank 12 reaches 3 inches, the float switch 36 (FIG. 6) activates the discharge pump 26 (FIG. 4). The discharge pump pulls the dirty water in the recovery tank 12 through the water filter 32 (FIG. 6) up the recovery tank 12 discharge hose 34 (FIG. 6) through the discharge pump into the toilet 62 (FIG. 5) or other sanitary disposal. When the discharge pump has removed all but about ½ inch of extracted water from the bottom of the recovery tank 12, it is deactivated by the float switch 36. When the extracted water level reaches 3 inches, the float switch 36 will reactivate the discharge pump 26.

Even though the present machine 10 uses a much higher water flow, more than 3 times as much, than other known machines, it leaves carpets much dryer. Since water is the only carrier of dirt and soils in the steam carpet cleaning process, the machine 10 has greatly increased the cleaning process of steam carpet cleaning by increasing the flow rate of said water.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

I claim:

1. A high flow carpet cleaning machine for cleaning carpets, comprising:

a recovery tank in flow communication with a water pick-up channel;

a vacuum source attached to said recovery tank maintaining a partial vacuum in said recovery tank;

a discharge pump connected to the interior of said recovery tank;

a solenoid valve connected to a water supply and in flow communication with a spray jet;

wherein said solenoid valve discharges water through said spray let unto said carpet, said vacuum source removes water from said carpet through said water pick-up channel into said recovery tank and said discharge pump removes water from said recovery tank, said recovery tank being less than 1 cubic foot in volume;

and further comprising a float switch on the interior of said recovery tank, said float switch operably connected to said discharge pump.

2. The float switch of claim 1 wherein said float switch activates said discharge pump when the water level rises to about three inches from the bottom of said recovery tank.

3. A method for high flow steam carpet cleaning, comprised of:

providing a recovery tank, said recovery tank being less than one cubic foot in volume;

creating a partial vacuum within said recovery tank; said recovery tank being in flow communication with a water pick-up channel;

discharging water from said tank by a discharge pump, said discharge pump providing means to remove water from said recovery tank; and, spraying water from a water source at high volume onto said carpet by a spray jet, said volume being at least 1.5 gallons per minute.

* * * * *